US008562385B2

(12) United States Patent
Matheny et al.

(10) Patent No.: US 8,562,385 B2
(45) Date of Patent: Oct. 22, 2013

(54) DOLL WITH WATER SQUIRTING FEATURE

(75) Inventors: Kelly Rae Matheny, Hacienda Heights, CA (US); Christopher Goff, Redondo Beach, CA (US); Jeffrey A. Saunders, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 265 days.

(21) Appl. No.: 13/045,750

(22) Filed: Mar. 11, 2011

(65) Prior Publication Data

US 2012/0231697 A1 Sep. 13, 2012

(51) Int. Cl.
*A63H 3/24* (2006.01)

(52) U.S. Cl.
USPC ..... 446/268; 446/305; 446/475; 222/79

(58) Field of Classification Search
USPC ..... 222/78, 79; 446/153, 268, 304, 305, 446/475
See application file for complete search history.

(56) References Cited

U.S. PATENT DOCUMENTS

| | | | | |
|---|---|---|---|---|
| 430,113 | A | 6/1890 | Colt | |
| 1,182,266 | A | 5/1916 | Gibson | |
| 1,593,419 | A | 7/1926 | Bielecki | |
| 1,694,959 | A * | 12/1928 | Cotton | 239/211 |
| 1,869,276 | A | 7/1932 | Precourt | |
| 1,951,263 | A | 3/1934 | Anzlovar | |
| 2,595,374 | A | 5/1952 | Studt | |
| 3,577,675 | A | 5/1971 | Kohner et al. | |
| 3,621,603 | A | 11/1971 | De Gelder | |
| 3,813,810 | A | 6/1974 | Majewski | |
| 4,185,413 | A * | 1/1980 | Goldfarb et al. | 446/197 |
| 4,286,780 | A | 9/1981 | Vermeire | |
| 4,507,097 | A | 3/1985 | Klawitter | |
| D279,590 | S | 7/1985 | Klawitter | |
| D280,000 | S | 8/1985 | Klawitter | |
| 4,630,756 | A * | 12/1986 | Amici et al. | 222/78 |
| 4,854,911 | A | 8/1989 | Berliner et al. | |
| 5,049,080 | A | 9/1991 | Kriebel et al. | |
| 5,071,387 | A * | 12/1991 | Pottick | 446/475 |
| 5,092,809 | A | 3/1992 | Kessler | |
| 5,288,260 | A | 2/1994 | Chen et al. | |
| 5,305,918 | A | 4/1994 | D'Andrade | |
| 5,318,202 | A * | 6/1994 | D'Andrade | 222/78 |
| 5,336,122 | A | 8/1994 | Lewis | |
| 5,385,472 | A | 1/1995 | Mullin | |
| 5,577,945 | A | 11/1996 | LaBelle | |
| 5,659,988 | A | 8/1997 | Kim et al. | |
| 5,667,419 | A * | 9/1997 | Spector | 446/72 |
| 5,725,126 | A | 3/1998 | Poissant | |
| 6,312,311 | B1 | 11/2001 | Wilhelm et al. | |
| 6,340,323 | B1 | 1/2002 | Glynn | |
| 6,386,939 | B1 | 5/2002 | Wu et al. | |
| 6,554,682 | B1 | 4/2003 | Tammera | |
| 6,579,141 | B2 | 6/2003 | Bayliss | |
| 6,716,082 | B1 | 4/2004 | Chen Pan | |
| 7,247,079 | B2 | 7/2007 | Maar | |
| 7,775,850 | B2 | 8/2010 | Todokoro | |
| 2007/0128969 | A1 | 6/2007 | Shrock et al. | |

* cited by examiner

*Primary Examiner* — John Ricci
(74) *Attorney, Agent, or Firm* — Edell, Shapiro & Finnan LLC

(57) ABSTRACT

A figure includes a body with a first portion including an inlet and a second portion including an outlet. The first portion is submersible in a liquid. A conduit extends between the inlet and the outlet. A pump mechanism is coupled to the conduit. The pump mechanism is operable by a user to draw liquid into the inlet, move the liquid through the conduit, and discharge the liquid from the outlet.

20 Claims, 8 Drawing Sheets

DOLL WITH WATER SQUIRTING FEATURE

FIELD OF THE INVENTION

The present invention relates to a doll, and in particular, to a doll including an outlet and a mechanism for discharging a liquid, such as water, from the outlet.

BACKGROUND OF THE INVENTION

Dolls have proven to be an extremely popular and long-lasting category of toy products. Water and bath toys have also proven to be a popular category of toy products. However, such toys have limited ability to be repositioned relative to a source of liquid. In addition, such toys lack the ability to draw liquid from an external source in which a portion of the toy is placed.

There is a need for a unique doll that is able to discharge or squirt water. In addition, there is a need for a doll that is able to discharge or squirt water while being positioned in a life-like or unique pose.

SUMMARY OF THE INVENTION

The present invention is directed to a figure including a body having a first portion including or defining an inlet, and a second portion including or defining an outlet. The first portion is submersible in a liquid such that the inlet is located in the liquid. A conduit extends between the inlet and the outlet. A pump mechanism is coupled to the conduit. The pump mechanism is operable by a user to draw the liquid into the inlet, move the liquid through the conduit, and discharge the liquid from the outlet.

In one embodiment, the first portion of the body includes a first appendage and the second portion of the body includes a second appendage. The inlet is disposed on the first appendage, and the outlet is disposed on the second appendage. In one implementation, the first appendage is a leg including a foot, and the inlet is disposed on the foot. In one implementation, the second appendage is an arm including a hand, and the outlet is disposed on the hand.

In one embodiment, the second portion of the body includes a torso and an arm having a hand pivotally connected to the torso. The outlet is disposed on the hand. The arm can be pivotally connected to the torso so that the location of the outlet relative to the body can vary. The first portion of the body includes a leg having a foot. The inlet is disposed on the foot. The conduit extends through the leg, torso and arm between the inlet and the outlet.

The present invention is also directed to a doll including a torso, a leg coupled to a lower portion of the torso, and an arm coupled to an upper portion of the torso. The leg includes a foot defining an inlet. The arm includes a hand defining an outlet. A pump mechanism is coupled to the torso, which is configured to draw a liquid into the inlet when the foot is submersed in the liquid, and discharge the liquid from the outlet. The pump mechanism is in communication with the inlet and the outlet. In one implementation, the pump mechanism includes a conduit extending between the inlet and the outlet.

In one embodiment, the leg is pivotally coupled to the lower portion of the torso. The leg includes a thigh portion hingedly connected to a calf portion at a knee portion, the conduit extending through the knee portion. The arm is pivotally coupled to the upper portion of the torso.

In one embodiment, an object is removably coupleable to the hand. The object includes an inlet and an outlet. The inlet of the object is alignable with and coupleable to the outlet in the hand, so that liquid moves from the outlet in the hand into the inlet in the object, through the object, and then discharges from the outlet in the object. In one implementation, the object is configured to resemble an animal.

The present invention is also directed to a figure having a torso including a chamber configured to retain a liquid, an appendage pivotally coupled to the torso, and a pump mechanism coupled to the torso. The appendage includes an opening in fluid communication with the liquid retaining chamber. The pump mechanism is configured to discharge liquid retained within the chamber and out the opening.

In one embodiment, the appendage is a first appendage and the opening is an outlet. The figure also includes a second appendage pivotally coupled to the torso. The second appendage includes an inlet in fluid communication with the chamber. The pump mechanism is configured to draw liquid into the chamber from the inlet.

In one embodiment, an object is removably coupleable to the appendage. The object includes an inlet and an outlet. The inlet of the object is alignable with and coupleable to the opening so that the liquid moves from the opening into the inlet in the object, through the object, and discharges from the outlet in the object.

In one embodiment, each of the inlet and the outlet is movable relative to the torso.

In another embodiment, the figure includes a torso, a first appendage pivotally coupled to the torso, the first appendage including an opening configured to be in fluid communication with an external liquid source, a second appendage pivotally coupled to the torso, the second appendage including an opening configured to discharge a liquid, and a pump mechanism coupled to the torso, the pump mechanism configured to draw in liquid through the opening in the first appendage and discharge liquid through the opening in the second appendage.

In one embodiment, the pump mechanism includes a flexible conduit extending between the opening in the first appendage and the pump mechanism.

In one embodiment, the first appendage is configured to be submersed into the external liquid source with the opening in the first appendage positioned to intake liquid from the external liquid source.

In one embodiment, the figure includes an object removably coupleable to the second appendage, the object including an inlet and an outlet, the inlet of the object alignable with and coupleable to the opening of the second appendage so that the liquid moves from the opening of the second appendage into the inlet in the object, through the object, and discharges from the outlet in the object.

BRIEF DESCRIPTION OF THE DRAWINGS

Like reference numerals have been used to identify like elements throughout this disclosure.

DETAILED DESCRIPTION OF THE INVENTION

In one embodiment, the doll or figure is configured to intake or receive a liquid, such as water, and discharge the liquid. The doll includes a mechanism that can be actuated by a user, such as a child, to draw in the liquid and discharge the liquid. The mechanism can be a pumping mechanism that has an actuator accessible outside the body of the doll. The doll may include an inlet or intake opening or port through which a liquid can be drawn. In addition, the doll may include an outlet or discharge opening or port through which the liquid can be projected or discharged. In one embodiment, the doll may include an internal reservoir or chamber in which liquid can be retained or stored temporarily until it is discharged from the doll.

Figure 1:
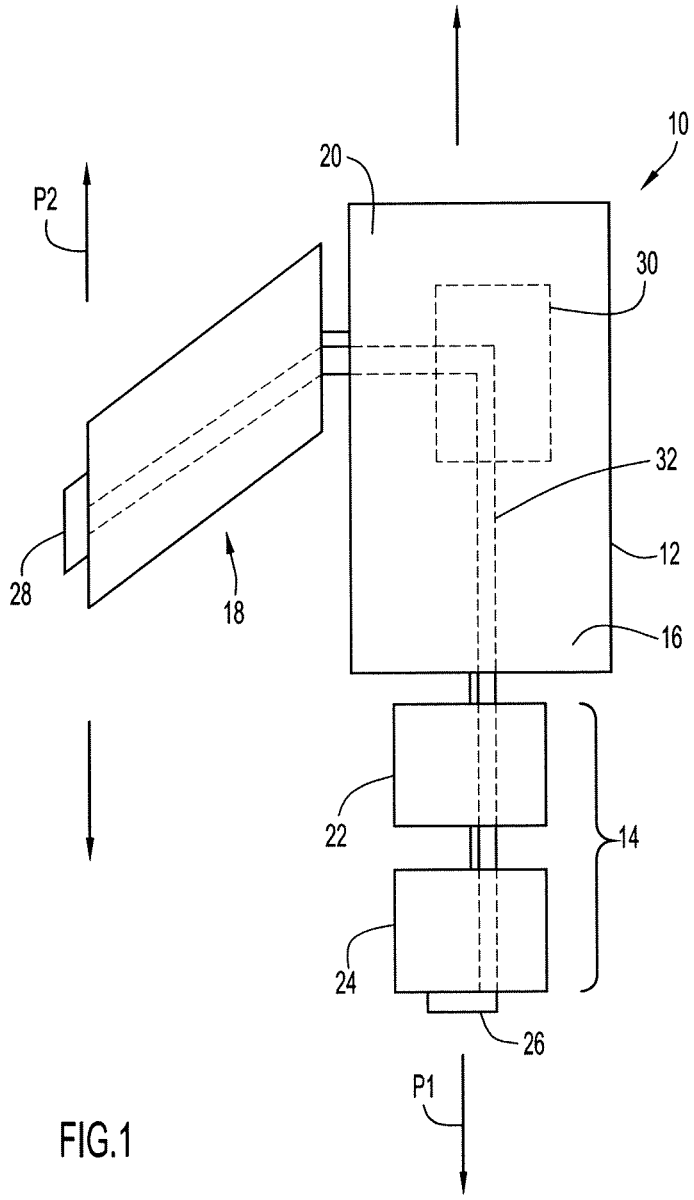
FIG. 1 illustrates a schematic diagram of a figure according to an embodiment of the present invention.

FIG. 1 illustrates a schematic diagram of a FIG. 10 according to an embodiment of the present invention. The FIG. 10 includes a torso 12, an appendage 14 coupled to a first portion 16 of the torso 12, and another appendage 18 coupled to a second portion 20 of the torso 12. In one implementation, appendages 14 and 18 can be pivotally coupled to and movable relative to the torso 12. In another implementation, either one or both of the appendages 14 and 18 can be fixed relative to the torso 12.

In one embodiment, as shown in FIG. 1, appendage 14 includes an upper portion 22 pivotally coupled to the torso 12, and a lower portion 24 pivotally coupled to the upper portion 22. Such an appendage 14 can be a leg for the doll 10.

In this embodiment, the appendage 14 includes an inlet 26. The inlet 26 is movable along a plane P1 relative to the body of the doll 10. The other appendage 18 includes an outlet 28 movable along another plane P2. The movement of the inlet 26 and the outlet 28 is determined in part by the structure of the appendages 14 and 18 and in particular, the joints between the appendages 14 and 18 and the body of the doll 10. In one implementation, the plane P1 along which the inlet 26 is movable is substantially parallel to the plane P2 along which the outlet 28 is movable. In another embodiment, the planes P1 and P2 can be at an angle relative to each other, such as being perpendicular.

A pump mechanism 30 (shown in phantom) is coupled to the torso 12. The pump mechanism 30 is configured to draw a liquid (e.g., such as water) into the inlet 26 when the inlet 26 is submersed in the liquid, and discharge the liquid from the outlet 28. In one embodiment, the pump mechanism 30 includes a flexible conduit 32 (shown partially in phantom) extending between the inlet 26 and the outlet 28.

Figure 2:
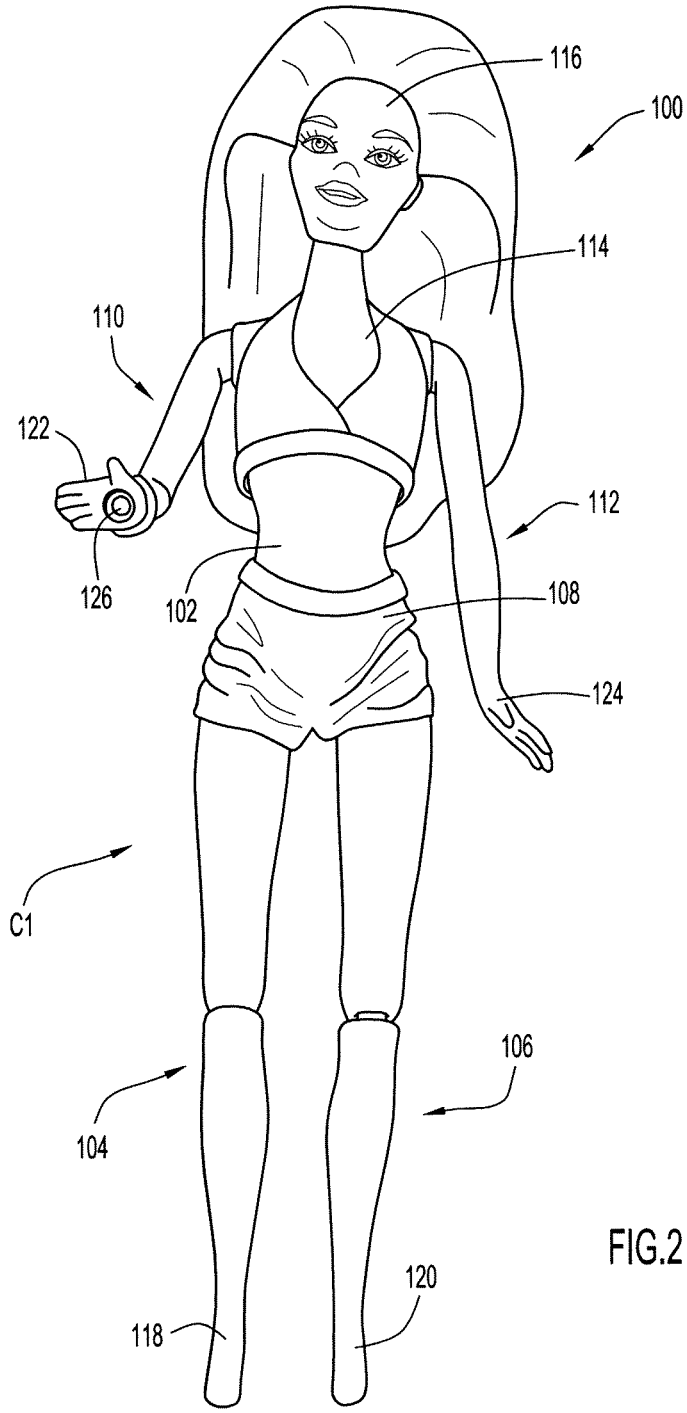
FIG. 2 illustrates a front perspective view of a doll according to another embodiment.
Figure 3:
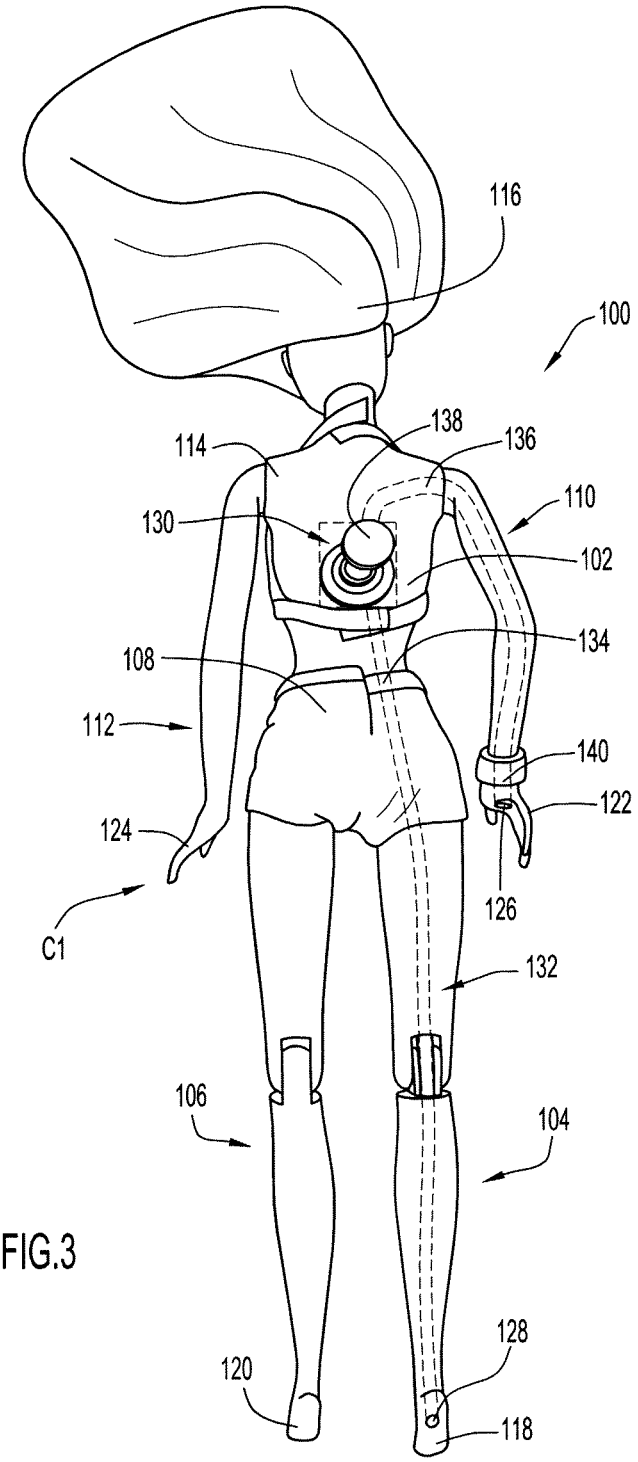
FIG. 3 illustrates a rear perspective view of the doll of FIG. 2.

A toy doll 100 according to another embodiment is illustrated in FIGS. 2 and 3. The doll 100 includes a torso 102, legs 104, 106 coupled to a lower portion 108 of the torso 102, arms 110, 112 coupled to an upper portion 114 of the torso 102, and a head 116 coupled to the upper portion 114 of the torso 102. Each of the legs 104, 106 includes a foot 118, 120, respectively, and each of the arms 110, 112 includes a hand 122, 124, respectively.

As shown in FIG. 2, an outlet 126 is disposed on or defined by the hand 122. As shown in FIG. 3, an inlet 128 is disposed on or defined by the foot 118. A pump mechanism 130 (shown in phantom) is coupled to the torso 102, and is configured to draw a liquid (e.g., such as water) into the inlet 128 when the foot 118 is submersed in the liquid, and discharge the liquid from the outlet 126 on the hand 122.

In one embodiment, the pump mechanism 130 includes or is coupled to a conduit 132 (partially shown in phantom in FIG. 3) extending between the inlet 128 and the outlet 126. The conduit 132 includes a lower portion 134 extending from and interconnecting the pump mechanism 130 and the inlet 128, and an upper portion 136 extending from and interconnecting the pump mechanism 130 and the outlet 126. Thus, the lower portion 134 of the conduit 132 extends from the inlet 128, through a cavity defined by the foot 118 and leg 104, and into a cavity defined by the torso 102 to the pump mechanism 130. The upper portion 136 of the conduit 132 extends from the pump mechanism 130 through the cavity defined by the torso 102, and through a cavity defined by the arm 110 and hand 122 to the outlet 126.

The pump mechanism 130 includes a trigger or plunger 138. Upon depression of the plunger 138 by a user, water is draw into the inlet 128, and moves upwardly through the lower portion 134 of the conduit 132 into or past the pump mechanism 130. The water is then forced from the pump mechanism 130 into and through the upper portion 136 of the conduit 132, and then discharged from the outlet 126 in the hand 122.

Figure 3A:
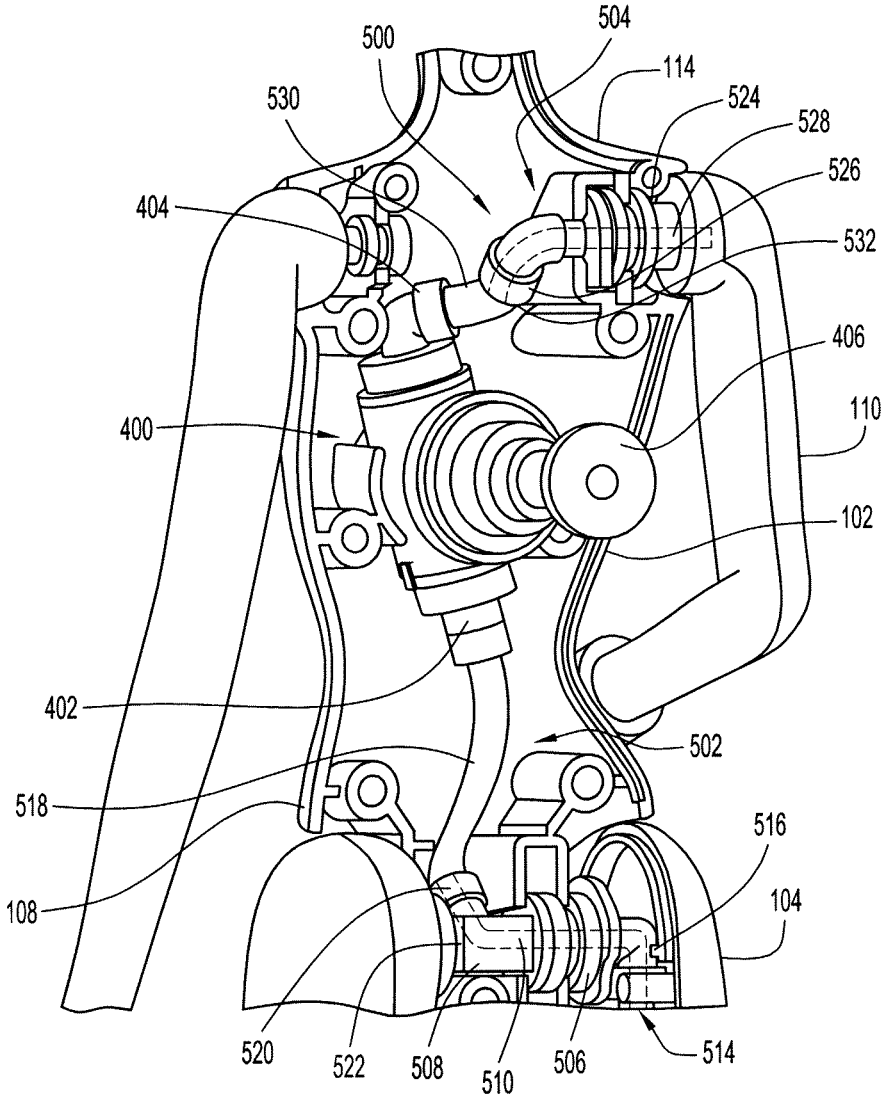
FIG. 3A illustrates a rear perspective view of internal components of the doll of FIG. 2 according to one embodiment, showing a pump mechanism and a conduit system.
Figure 3B:
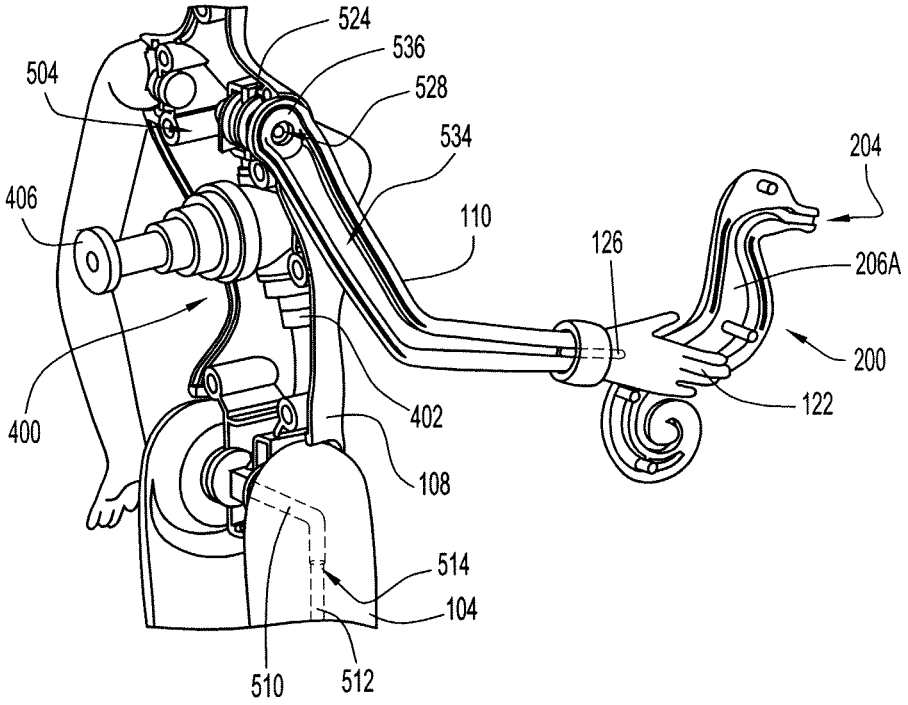
FIG. 3B illustrates another perspective view of the components shown in FIG. 3A, showing a sectional view of portions of the arm.

Referring to FIGS. 3A and 3B, the rear portion of the torso of the doll 100 has been removed to reveal some of the internal components. A pump mechanism 400 and conduit system 500 according to one embodiment of the invention are illustrated. The pump mechanism 400 includes a lower end portion 402, and upper end portion 404, and a plunger 406. The conduit system 500 includes a lower segment 502 extending between and interconnecting the inlet 128 (shown in FIG. 3) and the lower end portion 402 of the pump mechanism 400. The conduit system 500 also includes an upper segment 504 extending between and interconnecting the upper end portion 404 of the pump mechanism 400 and the outlet 126 in the hand 122 (shown in phantom in FIG. 3B). Similar to the pump mechanism 130, water is drawn into the inlet 128 and through the lower segment 502 of the conduit system 500, through the pump mechanism 400, and then through the upper segment 504 of the conduit system 500 and expelled from the outlet 126 upon actuation of the plunger 406.

With continued reference to FIGS. 3A and 3B, in one implementation, the leg 104 is pivotally coupled to the lower portion 108 of the torso 102 via a coupler 506. An extension member 508 is connected to or defined by the coupler 506. The coupler 506 and/or extension member 508 define a passage 510 (shown in phantom) through which water may flow. A portion 512 (shown in phantom in FIG. 3B) of the lower segment 502 extends between the inlet 128 and an opening or nozzle 514 provided on an outer end 516 of the coupler 506. Another portion 518 of the lower segment 502 extends between another opening or nozzle 520 provided on an inner end 522 of the extension member 508 and the lower end portion 402 of the pump mechanism 400. In one implementation, the portions 512 and 518 of the lower segment 502 of the conduit system 500 are flexible tubing. Alternatively, portion 518 is a groove or channel formed through the leg 104. The portion 512, passage 510 extending through the coupler 506 and extension member 508, and portion 518 collectively define the lower segment 502 of the conduit system 500.

The arm 110 is pivotally coupled to the upper portion 114 of the torso 102 via another coupler 524. Another extension member 526 is connected to or defined by the coupler 524. The coupler 524 and/or extension member 526 define a passage 528 (shown in phantom in FIG. 3A and drawn in FIG. 3B) through which water may flow. A tubing member 530 extends between the upper end portion 404 of the pump mechanism 400 and an opening or nozzle 532 providing on the extension member 526.

Referring to FIG. 3B, the arm 110 defines another passage 534 extending between an outer end 536 of the coupler 524 and the outlet 126. The tubing member 530, passage 528 extending through the extension member 526 and the coupler 524, and passage 534 extending through the arm 110 collectively define the upper segment 504 of the conduit system 500.

Thus, upon actuation of the plunger 406, water is drawn into the inlet 128 and flows upwardly through the lower segment 502 of the conduit system 500. The water then flows through a chamber provided in the pump mechanism 400, and is forced into and through the upper segment 504 of the conduit system 500. The water is then ejected from the outlet 126.

Figure 4:
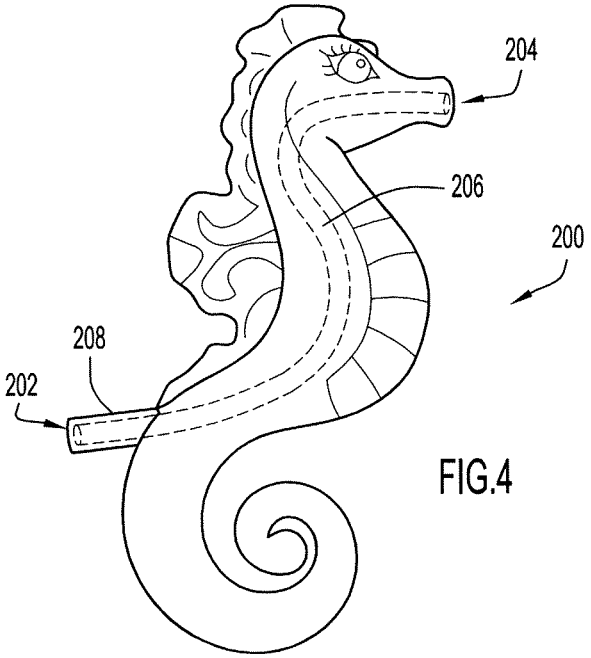
FIG. 4 illustrates a perspective view of a sea horse character coupleable to the doll of FIG. 2.
Figure 5:
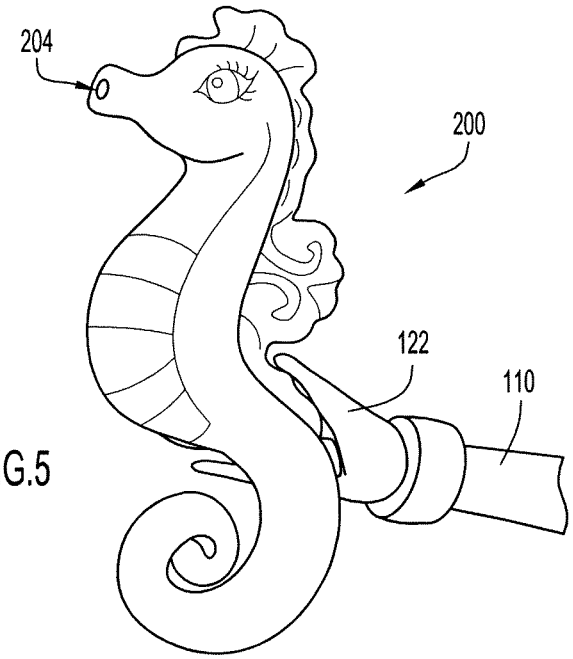
FIG. 5 illustrates a perspective view of the sea horse character of FIG. 4 coupled to a hand of the doll.

Referring to FIGS. 3B, 4 and 5, in one embodiment, an object 200 is removably coupleable to the hand 122. In one implementation, the object 200 is configured to resemble an animal, such as a sea horse character. In alternative embodiments, the object 200 may be configured to resemble an inanimate object (e.g., a purse, a bag, a weapon, a sports item, etc.) a plant (e.g., a flower), or any other object coupleable to the doll 100. The object 200 includes an inlet 202 and an outlet 204, as shown in FIG. 4. The inlet 202 of the object 200 is in fluid communication with the outlet 204 of the object 200 via a cavity 206A (such as shown in FIG. 3B) or a conduit 206 (as shown in phantom in FIG. 4) disposed within or defined by the object 200. The inlet 202 of the object 200 may be aligned with and coupled to the outlet 204 in the hand 122, as shown in FIG. 5.

In one implementation, the inlet 202 is defined by a nozzle 208 that is received in the outlet 126 and a distal end portion 140 (shown in FIG. 3) of the upper portion 136 of the conduit 132, such as by friction fit. Water moving through the upper portion 136 of the conduit 132 in the doll 100 is forced through the outlet 126 in the hand 122 and into the inlet 202 of the object 200. The water then moves through the conduit 206 in the object 200, and is discharged from the outlet 204 of the object 200. Thus, the water may be discharged either from the outlet 204 of the object 200 when the object 200 is coupled to the hand 122 of the doll 100, or the water may be discharged from the outlet 126 on the hand 122 when the object 200 is decoupled from the hand 122.

Figure 6:
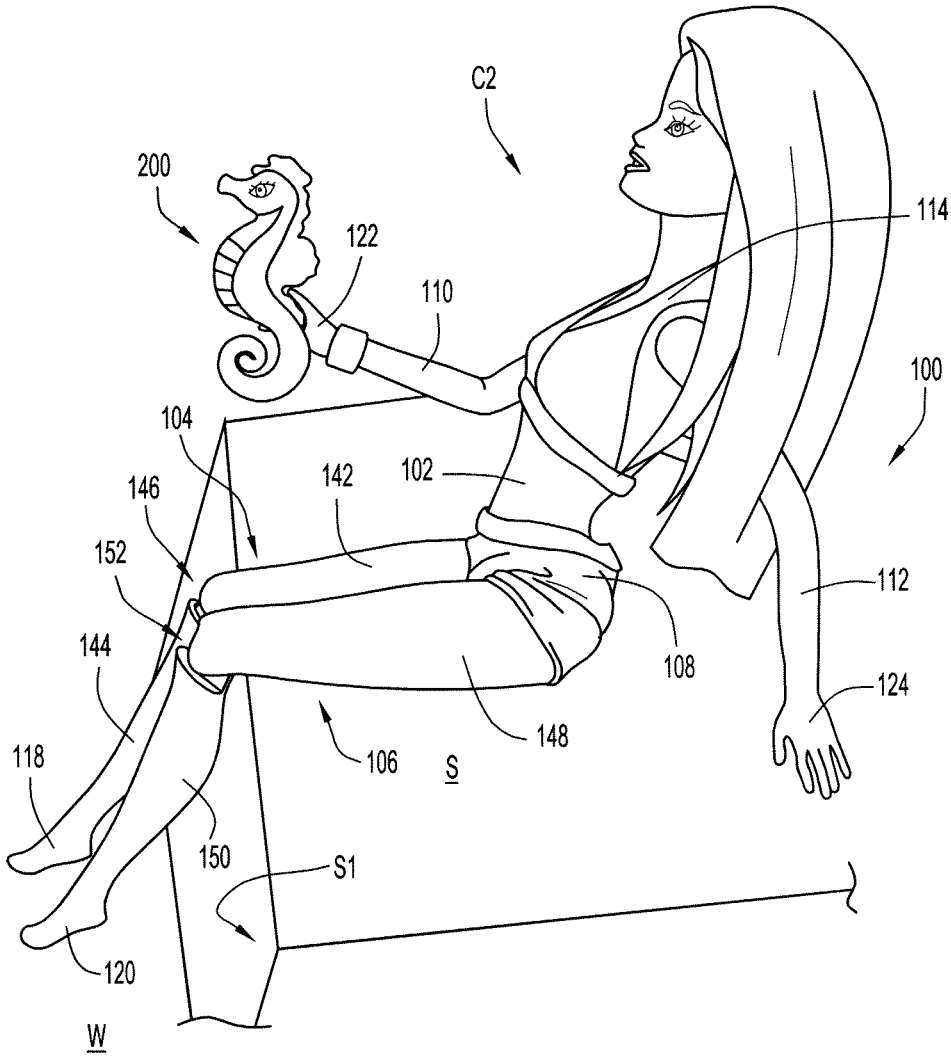
FIG. 6 illustrates a side perspective view of the doll of FIG. 2 with the sea horse character coupled to the hand of the doll.

Referring to FIG. 6, in one embodiment, each of the legs 104, 106 is pivotally coupled to the lower portion 108 of the torso 102. Leg 104 includes an upper or thigh portion 142 hingedly coupled to a lower or calf portion 144 to define a knee portion 146. Similarly, leg 106 includes an upper or thigh portion 148 hingedly coupled to a lower or calf portion 150 to define another knee portion 152. The doll 100 may be repositioned between a standing or fully extended position C1 (as shown in FIGS. 2 and 3) and a sitting position C2 (as shown in FIG. 6). Similarly, the arms 110, 112 are pivotally coupled to the upper portion 114 of the torso 102.

As the leg 104 is pivotally movable at the knee portion 146 as well as between the thigh portion 142 and the lower portion 108 of the torso 102, the doll 100 may be disposed in its sitting position C2 on a support surface S, with the calf portion 144 pivoted downwardly, such as near or against an edge 51 of the support surface S, so that the inlet 128 on the foot 118 is submersed in a water or liquid source W (e.g., a basin, pool or bathtub), which is external to the body of the doll 100. The hand 122 of the arm 110 may be pivoted outwardly and away from the torso 102, so that water discharged from the outlet 126 (or from the outlet 204 of the object 200) is projected outwardly and away from the doll 100. The other arm 112 may be pivoted back so that the corresponding hand 124 braces against the support surface S, thereby further stabilizing the doll 100 on the support surface S.

Figure 7:
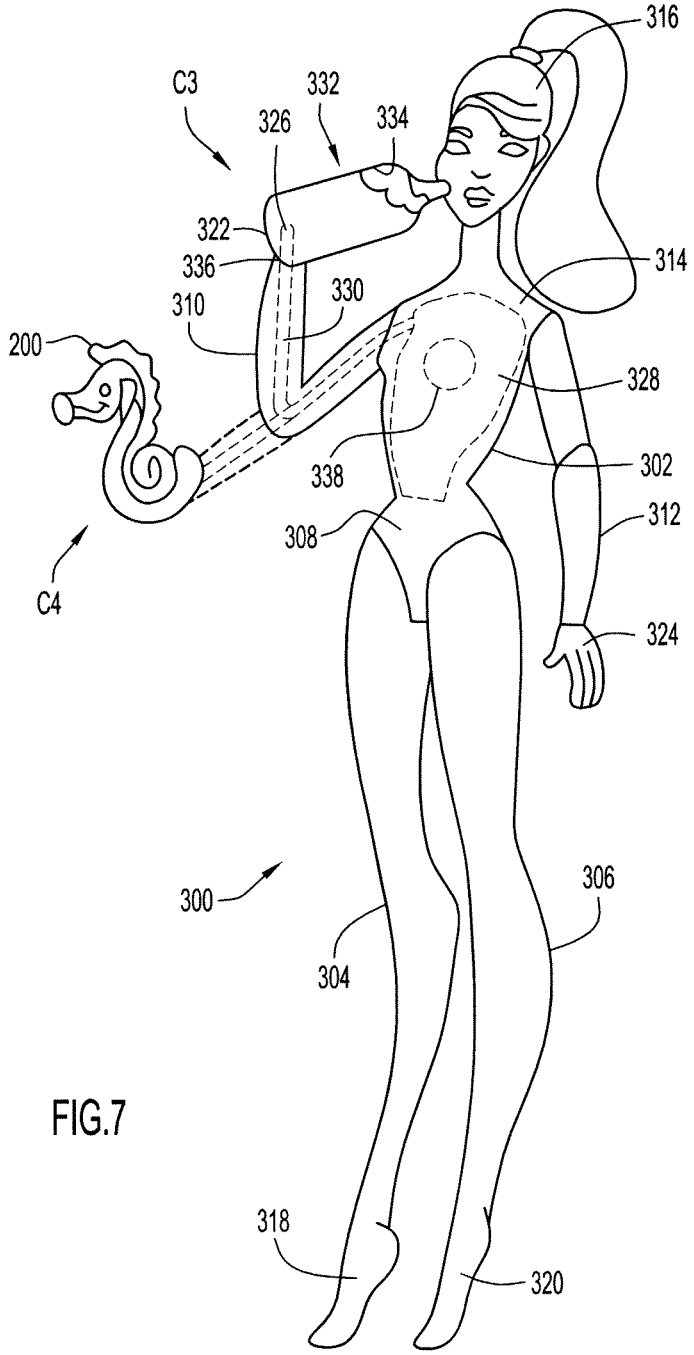
FIG. 7 illustrates a front perspective view of a doll according to another embodiment.

FIG. 7 illustrates a toy doll 300 according to another embodiment. Similar to doll 100, doll 300 includes a torso 302, legs 304, 306 coupled to a lower portion 308 of the torso 302, arms 310, 312 coupled to an upper portion 314 of the torso 302, and a head 316 coupled to the upper portion 314 of the torso 302. Each of the legs 304, 306 includes a foot 318, 320, respectively, and each of the arms 310, 312 includes a hand 322, 324, respectively.

An opening 326 (shown in phantom) is disposed on or defined by the hand 322. A liquid retaining chamber 328 (shown in phantom) is defined by or disposed in the torso 302. A conduit 330 (shown in phantom) is defined by or extends from the opening 326 in the hand 322, through the arm 310, and to the liquid retaining chamber 328. Thus, the opening 326 is in fluid communication with the liquid retaining chamber 328 via the conduit 330. A liquid (e.g., such a water), may be poured or otherwise flow into the opening 326. The liquid then moves through the conduit 330 and into the liquid retaining chamber 328.

In one embodiment, a bottle member 332 is coupleable to the hand 322, as shown in FIG. 7. The bottle member 332 includes a cavity 334 for retaining a liquid. The bottle member 332 includes an outlet or nozzle (e.g., similar to the nozzle 208 disclosed above and illustrated in FIG. 4), which is received in the opening 326 and an end portion 336 of the conduit 330, such as by friction fit. Liquid retained within the cavity 334 of the bottle member 332 drains or moves through its associated outlet or nozzle and into the opening 326 when the bottle member 332 is coupled to the hand 322. The liquid then moves through the conduit 330 and into the liquid retaining chamber 328. In one implementation, the bottle member 332 may include another opening at an end portion opposite to its outlet, so that the liquid more easily drains from the cavity 334.

The arm 310 may be moved to a raised position C3, so that the liquid within the cavity 334 of the bottle member 332 drains therefrom and moves through the conduit 330 to the liquid retaining chamber 328 via gravity. In addition, the bottle member 332 may be positioned proximate to the head 316 of the doll 300 when the arm 310 is in its raised position C3, so that the doll 300 appears to be "drinking" the liquid within the bottle member 332.

It should be understood that other objects including a cavity for retaining liquid, or a conduit though which a liquid flow, may be utilized instead of the illustrated bottle member 332. Alternatively or in addition, liquid may be poured directly into the opening 326 in the hand 322. Alternatively or in addition, the opening 326 may be submersed in a liquid so that the liquid flows into the opening 326.

Once a volume of liquid is disposed within the liquid retaining chamber 328, the bottle member 332 (or other object) may be decoupled from the hand 322. The liquid within the liquid retaining chamber 328 may then be ejected therefrom, back through the conduit 330, and expelled from the opening 326.

A pump mechanism 338 (shown in phantom) is coupled to the liquid retaining chamber 328 and operative to expel liquid therefrom. In one embodiment, the pump mechanism 338 includes a trigger or plunger in communication with the liquid retaining chamber 328, which when depressed, expels liquid from the liquid retaining chamber 328. In another embodiment, the liquid retaining chamber 328 is at least partially defined by a flexible member (e.g., such as a rubber panel or section), which extends from or partially defines a back portion of the torso 302. Upon depression of the flexible member, the interior volume of the liquid retaining chamber 328 is substantially reduced so that liquid retained therein is expelled. Thus, the flexible member functions as the pump mechanism 338.

Thus, upon actuation of the pump mechanism 338, liquid retained within the liquid retaining chamber 328 is forced back out of the conduit 330. The liquid may be rapidly expelled from the opening 326, such as in a liquid spray or stream. When ejecting liquid from the opening 326, the arm 310 may be moved from its raised position C3 to a lowered position C4, shown in phantom in FIG. 7.

In one embodiment, the object 200 may be coupled to the hand 322, such as described above. Liquid in the liquid retaining chamber 328 may thus be expelled therefrom and move through the conduit 330 to the opening 326. The liquid is then forced from the opening 326 in the hand 322 into the inlet 202 of the object 200, through the conduit 206 in the object 200, and is discharged from the outlet 204 of the object 200. Thus, the liquid may be discharged either from the outlet 204 of the object 200 when the object 200 is coupled to the hand 322 of the doll 300, or the liquid may be discharged from the opening 326 on the hand 322, such as described above.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A figure comprising:

a body with a first portion including an inlet and a second portion including an outlet, the first portion submersible in a liquid such that the inlet is located in the liquid and the second portion including an appendage that is an arm, the arm including the outlet;

a conduit extending between the inlet and the outlet; and a pump mechanism coupled to the conduit, the pump mechanism operable by a user to draw the liquid into the inlet, move the liquid through the conduit, and discharge the liquid from the outlet.

2. The figure of claim 1, wherein the appendage is a first appendage and the first portion includes a second appendage, the inlet being disposed on the second appendage.

3. The figure of claim 2, wherein the second appendage is a leg including a foot, the inlet being disposed on the foot.

4. The figure of claim 1, wherein the arm includes a hand, the outlet being disposed on the hand.

5. The figure of claim 1, wherein the second portion includes an object coupled to the arm, the outlet being disposed on the object.

6. The figure of claim 5, wherein the arm includes a hand, and the object is removably coupled to the hand.

7. The figure of claim 5, wherein the second portion includes a torso, the arm being pivotally connected to the torso so that the location of the outlet relative to the body can vary.

8. The figure of claim 1, wherein the first portion includes a leg having a foot, the inlet is disposed on the foot, and the conduit extends through the leg.

9. The figure of claim 8, wherein the leg includes a thigh portion hingedly connected to a calf portion at a knee portion, the conduit extending through the knee portion.

10. A doll comprising:

a torso;

a leg coupled to the torso, the leg including a foot defining an inlet;

an arm coupled to the torso, the arm including a hand defining an outlet; and a pump mechanism coupled to the torso and in communication with the inlet and the outlet, the pump mechanism being configured to draw a liquid into the inlet when the foot is submersed in the liquid, and discharge the liquid from the outlet.

11. The doll of claim 10, wherein the leg is pivotally coupled to a lower portion of the torso.

12. The doll of claim 11, wherein the leg includes a thigh portion hingedly connected to a calf portion.

13. The doll of claim 10, wherein the arm is pivotally coupled to a upper portion of the torso.

14. The doll of claim 10, wherein the pump mechanism includes a conduit extending between the inlet and the outlet.

15. The doll of claim 10, further comprising:

an object removably coupleable to the hand, the object including an inlet and an outlet, wherein the inlet of the object is aligned with and coupled to the outlet in the hand so that the liquid moves from the outlet in the hand into the inlet in the object, through the object, and discharges from the outlet in the object.

16. The doll of claim 10, wherein each of the inlet and the outlet is movable relative to the torso.

17. A figure comprising:

a torso;

a first appendage pivotally coupled to the torso, the first appendage including an opening configured to be in fluid communication with an external liquid source;

a second appendage pivotally coupled to the torso, the second appendage including an opening configured to discharge a liquid; and a pump mechanism coupled to the torso, the pump mechanism configured to draw in liquid through the opening in the first appendage and discharge liquid through the opening in the second appendage.

18. The figure of claim 17, wherein the pump mechanism includes a flexible conduit extending between the opening in the first appendage and the pump mechanism.

19. The figure of claim 17, wherein the first appendage is configured to be submersed into the external liquid source with the opening in the first appendage positioned to intake liquid from the external liquid source.

20. The figure of claim 17, further comprising:

an object removably coupleable to the second appendage, the object including an inlet and an outlet, the inlet of the object alignable with and coupleable to the opening of the second appendage so that the liquid moves from the opening of the second appendage into the inlet in the object, through the object, and discharges from the outlet in the object.

* * * * *

UNITED STATES PATENT AND TRADEMARK OFFICE

CERTIFICATE OF CORRECTION

PATENT NO. : 8,562,385 B2
APPLICATION NO. : 13/045750
DATED : October 22, 2013
INVENTOR(S) : Kelly Rae Matheny, Christopher Goff and Jeffrey A. Saunders It is certified that error appears in the above-identified patent and that said Letters Patent is hereby corrected as shown below:

In the Specification

Column 5, Line 65, change "51" to --S1--

Signed and Sealed this
Tenth Day of December, 2013

Margaret A. Focarino

Margaret A. Focarino
*Commissioner for Patents of the United States Patent and Trademark Office*